US010676904B2

(12) United States Patent
McCormack

(10) Patent No.: US 10,676,904 B2
(45) Date of Patent: Jun. 9, 2020

(54) TOILET FLAPPER

(71) Applicant: Sean McCormack, Congers, NY (US)

(72) Inventor: Sean McCormack, Congers, NY (US)

(73) Assignee: STP INNOVATIONS LLC, Congers, NY (US)

( * ) Notice: Subject to any disclaimer, the term of this patent is extended or adjusted under 35 U.S.C. 154(b) by 19 days.

(21) Appl. No.: 15/989,503

(22) Filed: May 25, 2018

(65) Prior Publication Data

US 2018/0340321 A1 Nov. 29, 2018

Related U.S. Application Data

(60) Provisional application No. 62/538,771, filed on Jul. 30, 2017, provisional application No. 62/511,986, filed on May 27, 2017.

(51) Int. Cl.
*E03D 1/30* (2006.01)

(52) U.S. Cl.
CPC ..... *E03D 1/308* (2013.01)

(58) Field of Classification Search
CPC ..... E03D 1/308
USPC ..... 4/393
See application file for complete search history.

(56) References Cited

U.S. PATENT DOCUMENTS 3,903,551 A * 9/1975 Johnson ..... E03D 1/14 4/326
4,811,432 A * 3/1989 Harris ..... E03D 1/144 4/325
5,924,143 A * 7/1999 Harrison ..... E03D 1/308 4/325
5,960,482 A * 10/1999 Chang ..... E03D 1/308 4/325
2010/0050331 A1* 3/2010 Sim ..... E03D 1/142 4/324

* cited by examiner

*Primary Examiner* — Huyen D Le
(74) *Attorney, Agent, or Firm* — Botos Churchill IP Law LLP

(57) ABSTRACT

The present disclosure describes toilet flappers having an adjustable length cord. For example, the present disclosure describes a toilet flapper having a body and two arms. The body has a top surface and a bottom surface. On the top surface, there is a raised portion housing a cord, a locking mechanism, and a spring. In order to install the toilet flapper, a user can grab a hook attached to the end of the cord and pull enough of the cord out of the raised portion so that the user can attach the hook to, for example, a flush lever. Afterwards, the user can press down on the raised portion in order to activate the locking mechanism and prevent any more of the cord from being pulled back into the raised portion by the spring.

23 Claims, 7 Drawing Sheets

TOILET FLAPPER

CROSS-REFERENCE TO RELATED APPLICATIONS

This application claims the benefit of U.S. Provisional Application Ser. No. 62/538,771, filed Jul. 30, 2017 and U.S. Provisional Application Ser. No. 62/511,986, filed May 27, 2017, the disclosures of which are hereby incorporated by reference herein.

TECHNICAL FIELD

The present disclosure generally relates to toilet flappers. More specifically, the present disclosure describes toilet flappers having an adjustable length cord.

BACKGROUND

A toilet is a sanitization fixture that is used for disposal of feces and urine. Nearly every household in the United States has at least one toilet. Moreover, nearly everyone in the United States uses a toilet, in one form or another. As a result, there is a large demand for toilets and accessories for toilets.

People tend to run into simple problems with their toilets. Some of the most common problems involve the toilet flapper. Conventional toilets include a bowl and a water tank mounted on top of a rear portion of the bowl. Inside the water tank, there is often a fill valve, a drain hole, and a toilet flapper. The fill valve is typically connected to a water supply line. The drain hole is typically located at the bottom of the water tank. Unless the toilet is being flushed, the toilet flapper seals the drain hole. When the toilet is flushed the flapper is moved (typically raised) to permit water to flow from the water tank into the bowl.

Typically, the toilet flapper is connected to a flush lever with a chain. Furthermore, the flush lever is typically connected to a handle located on the outside of the water tank. A person can use the handle to pull the chain, thereby moving the toilet flapper off of the drain hole (and flush the toilet by the contents of the tank emptying through the drain hole). Often people encounter problems with their toilets because the chain gets stuck on the flapper. In some instances, this may prevent the toilet flapper from sealing the drain hole, which, in turn, prevents the water tank from filling up. People also encounter similar problems when the toilet flapper and chain get old.

Replacing a toilet flapper can be a frustrating process, in part, because the chain of a new toilet flapper needs to be adjusted before it can be properly installed. Thus, a need exists for a toilet flapper than can be installed easily and quickly.

BRIEF SUMMARY

The present disclosure describes toilet flappers having an adjustable length cord. In some embodiments, in comparison to conventional toilet flappers, the toilet flappers disclosed herein can be installed easily and quickly.

One aspect of the present disclosure relates to a toilet flapper comprising: one or more arms, a body, a cord, and a locking mechanism. A hook is attached to a first end of the cord. The body has a top surface and a bottom surface, wherein the top surface comprises a raised portion, wherein the raised portion houses one or more springs and at least a portion of the cord, wherein a second end of the cord is attached to the one or more springs inside the raised portion, wherein a portion of the cord may be pulled out of the raised portion by a user through an opening in the raised portion, and wherein the one or more springs impart a retraction tension on the cord that pulls the cord back into the raised portion. The locking mechanism can impart a locking tension that is equal to or greater than the retraction tension imparted by the one or more springs in the raised portion of the body thereby preventing the one or more springs from pulling a portion of the cord that has been pulled out of the raised portion by a user back into the raised portion.

In some embodiments, a ball connects the first end of the cord to the hook. In some embodiments, the one or more springs inside the raised portion include at least one spiral torsion spring. In some embodiments, the one or more arms are configured to attach the toilet flapper to an overflow pipe in a water tank of a toilet. In some embodiments, a length of the cord is sufficient to connect the hook to a flush lever of a toilet after the toilet flapper has been positioned above a drain hole of a water tank of the toilet such that the toilet flapper seals the drain hole.

In some embodiments, the locking mechanism is housed inside the raised portion of the body. In some embodiments, the locking mechanism comprises a button, and wherein the locking mechanism is oriented and positioned within the raised portion such that a user can press the button by pressing down on the raised portion. In some embodiments, a user can activate or deactivate the locking mechanism by pressing the button.

In some embodiments, the locking mechanism is outside of and separate from the raised portion of the body, and wherein the locking mechanism is attached to a portion of the cord that is outside of the raised portion. In some embodiments, the locking mechanism comprises a button, an inlet, and an outlet, wherein the cord enters the locking mechanism through the inlet and exits the locking mechanism through the outlet, wherein the locking mechanism configured to slide up or down the cord when the button is depressed, and wherein the locking mechanism is configured to resist sliding up or down the cord the button is undepressed.

In some embodiments, the locking mechanism is integrated with the hole in the raised portion of the body. In some embodiments, the locking mechanism comprises a first button and a second button, wherein the locking mechanism is configured such that the one or more springs in the raised portion of the body are prevented by the locking mechanism from pulling a portion of the cord that has been pulled out of the raised portion by a user back into the raised portion when the first button is depressed, and wherein the locking mechanism is configured such that the one or more springs in the raised portion of the body are allowed by the locking mechanism to pull a portion of the cord that has been pulled out of the raised portion by a user back into the raised portion when the second button is depressed. In some embodiments, the first and second buttons are configured such that (a) when the first button is depressed, the second button is pushed outwardly to an undepressed state and (b) when the second button is depressed, the first button is pushed outwardly to an undepressed state.

Another aspect of the present disclosure relates to a toilet flapper comprising: one or more arms, a body, a cord, and a locking mechanism. A hook is attached to a first end of the cord. The body has a top surface and a bottom surface, wherein the top surface comprises a raised portion, wherein the raised portion houses one or more springs and at least a portion of the cord, wherein a second end of the cord is attached to the one or more springs inside the raised portion, wherein a portion of the cord may be pulled out of the raised portion by a user through an opening in the raised portion, and wherein the one or more springs impart a retraction tension on the cord that pulls the cord back into the raised portion. The locking mechanism comprises a button, an inlet, and an outlet, wherein the cord enters the locking mechanism through the inlet and exits the locking mechanism through the outlet, wherein the locking mechanism configured to slide up or down the cord when the button is depressed, and wherein the locking mechanism is configured to resist sliding up or down the cord the button is undepressed.

In some embodiments, the one or more springs inside the raised portion include at least one spiral torsion spring. In some embodiments, at least a portion of a chamber inside the raised portion extends vertically below the entirety of the top surface of the body, and wherein the one or more springs and the at least a portion of the cord are housed in the chamber. In some embodiments, a length of the cord is sufficient to connect the hook to a flush lever of a toilet after the toilet flapper has been positioned above a drain hole of a water tank of the toilet such that the toilet flapper seals the drain hole.

In some embodiments, the toilet flapper can be used in a method comprising: positioning the toilet flapper of claim 14 above a drain hole of a water tank of a toilet such that the toilet flapper seals the drain hole; attaching the hook of the toilet flapper to a flush lever of the toilet, in part, by pulling a portion of the cord out of the raised portion of the toilet flapper; pressing down on the button of the locking mechanism and simultaneously sliding the locking mechanism down the cord toward the body of the toilet flapper; and releasing the button of the locking mechanism. In some embodiments, the locking mechanism is slid down the cord until it touches the hole in the raised portion of the body of the toilet flapper. In some embodiments, the method further comprises: attaching the toilet flapper to an overflow pipe in the water tank of the toilet.

BRIEF DESCRIPTION OF DRAWINGS

FIG. 2(*b*) is a photograph of a user installing the toilet flapper of FIG. 2(*a*).

FIG. 2(*c*) is another photograph of a user installing the toilet flapper of FIG. 2(*a*).

FIG. 3(*b*) illustrates a hook, cord, and locking mechanism of the toilet flapper of FIG. 3(*a*).

FIG. 3(*c*) illustrates a cord and locking mechanism of the toilet flapper of FIG. 3(*a*).

DETAILED DESCRIPTION

Figure 1:
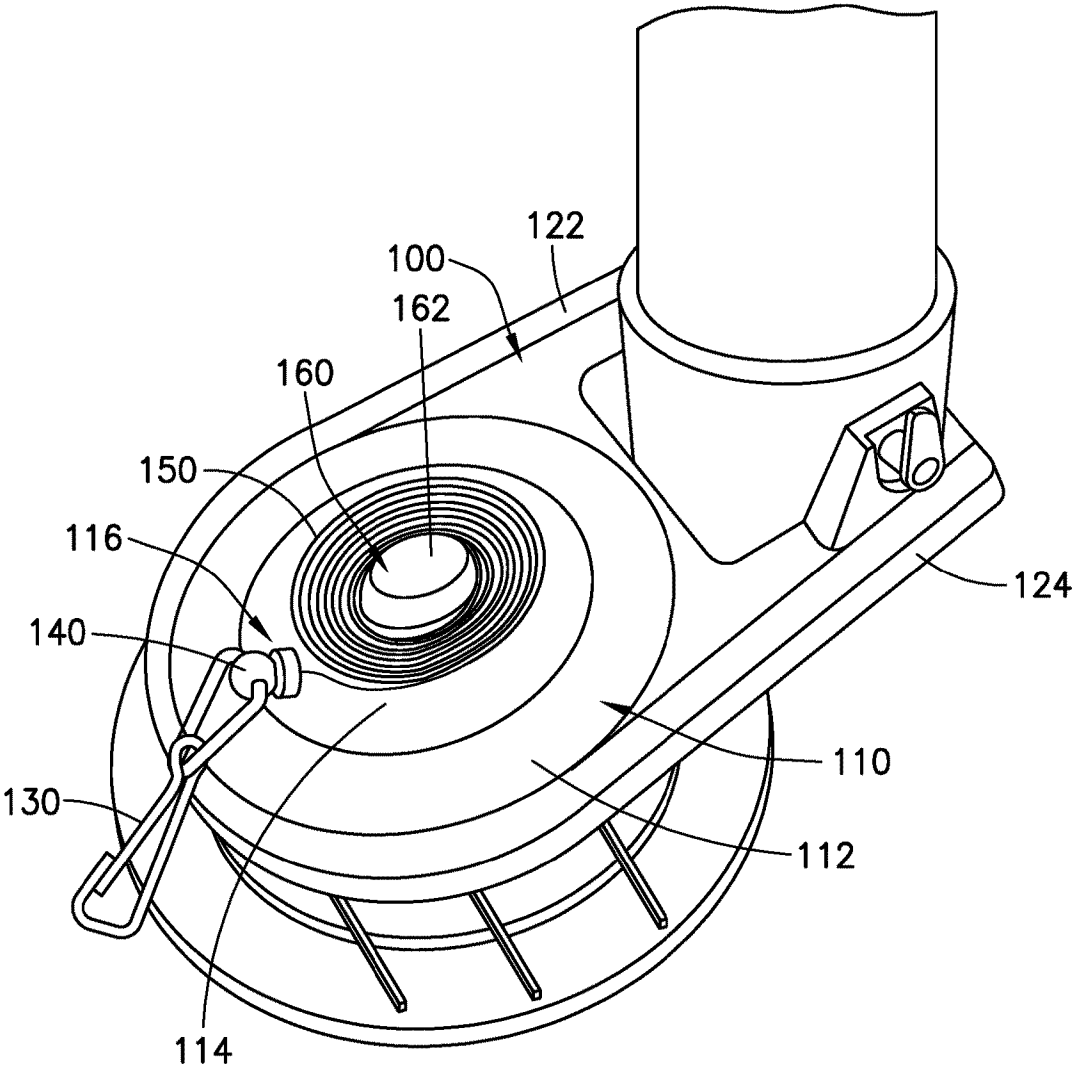
FIG. 1 illustrates an embodiment of a toilet flapper as described herein.

Embodiments of the present disclosure are described in detail with reference to the drawing figures wherein like reference numerals identify similar or identical elements. It is to be understood that the disclosed embodiments are merely examples of the disclosure, which may be embodied in various forms. Well-known functions or constructions are not described in detail to avoid obscuring the present disclosure in unnecessary detail. Therefore, specific structural and functional details disclosed herein are not to be interpreted as limiting, but merely as a basis for the claims and as a representative basis for teaching one skilled in the art to variously employ the present disclosure in virtually any appropriately detailed structure.

FIG. 1 illustrates an embodiment of a toilet flapper. As shown, toilet flapper 100 includes body 110, arm 122, arm 124, hook 130, ball 140, cord 150, and locking mechanism 160. Arms 122 and 124 may be used to moveably attach toilet flapper 100 to an overflow pipe near the drain hole of the water tank of a toilet. One skilled in the art is aware of the many known different configurations for attaching the toilet flapper so that it can be raised from and lowered onto the drain hole. Such configurations are not exhaustively described herein. Body 110 has a top surface 112 and a bottom surface (not shown). The top surface 112 includes a raised portion 114. Cord 150 and locking mechanism 160 are located inside raised portion 114. However, as shown in FIG. 1, the inside of raised portion 114 is exposed. In some embodiments, the inside of raised portion 114 may extend vertically below the entirety of top surface 112. Spring 170 provides a force that pulls cord 150 into raised portion 114. In some embodiments, body 110, arm 122, and/or arm 124 may be constructed with a rubber material. Furthermore, in some embodiments, hook 130, ball 140, and/or cord 150 may be constructed with a water-resistant material, such as stainless steel or plastic. Moreover, in some embodiments, cord 150 may be constructed as one continuous strand of material and, in other embodiments, cord 150 may have one or more discontinuities, such as a chain comprising a plurality of links.

In order to install toilet flapper 100, a user can grab hook 130 and pull a portion of cord 150 out of raised portion 114. As shown, cord 150 can be pulled out of raised portion 114 through hole 116. In this embodiment, locking mechanism 160 has a button 162 and a spring (not shown). The spring provides a force that pulls cord 150 into raised portion 114. However, the force of the spring can be overcome by a user pulling cord 150 out of raised portion 114. In some embodiments, the spring may be positioned inside locking mechanism 160 beneath button 162. In some embodiments, the spring may be a spiral torsion spring. In some embodiments, the spring may cooperate with one or more other springs inside locking mechanism in order to provide a force that pulls cord 150 into raised portion 114. After a user has connected hook 130 to, for example, a flush lever, the user can push down on raised portion 114 in order to push down button 162 and activate locking mechanism 160. Pushing down button 162 locks the current length of cord 150 and keeps a slack free line going from toilet flapper 100 to the flush lever. Subsequently, the user can push down on button 162, again, in order to release cord 150 for additional adjustments.

Various modifications can be made to toilet flapper 100. For example, in this embodiment, ball 140 provides a secure connection between hook 130 and cord 150. However, in other embodiments, other types of mechanisms can be used to connect hook 130 and cord 150. As another example, in this embodiment, raised portion 114 is circular and positioned centrally on the top surface 112 of body 110. However, in other embodiments, raised portion 114 can have a different shape or be located in a different position. As yet another example, in this embodiment, cord 150 is positioned in a spiral formation within raised portion 112 and locking mechanism 160 is centrally positioned within raised portion 114. However, in other embodiments, cord 150 and locking mechanism 160 can be positioned differently within raised portion 114.

Figure 2A:
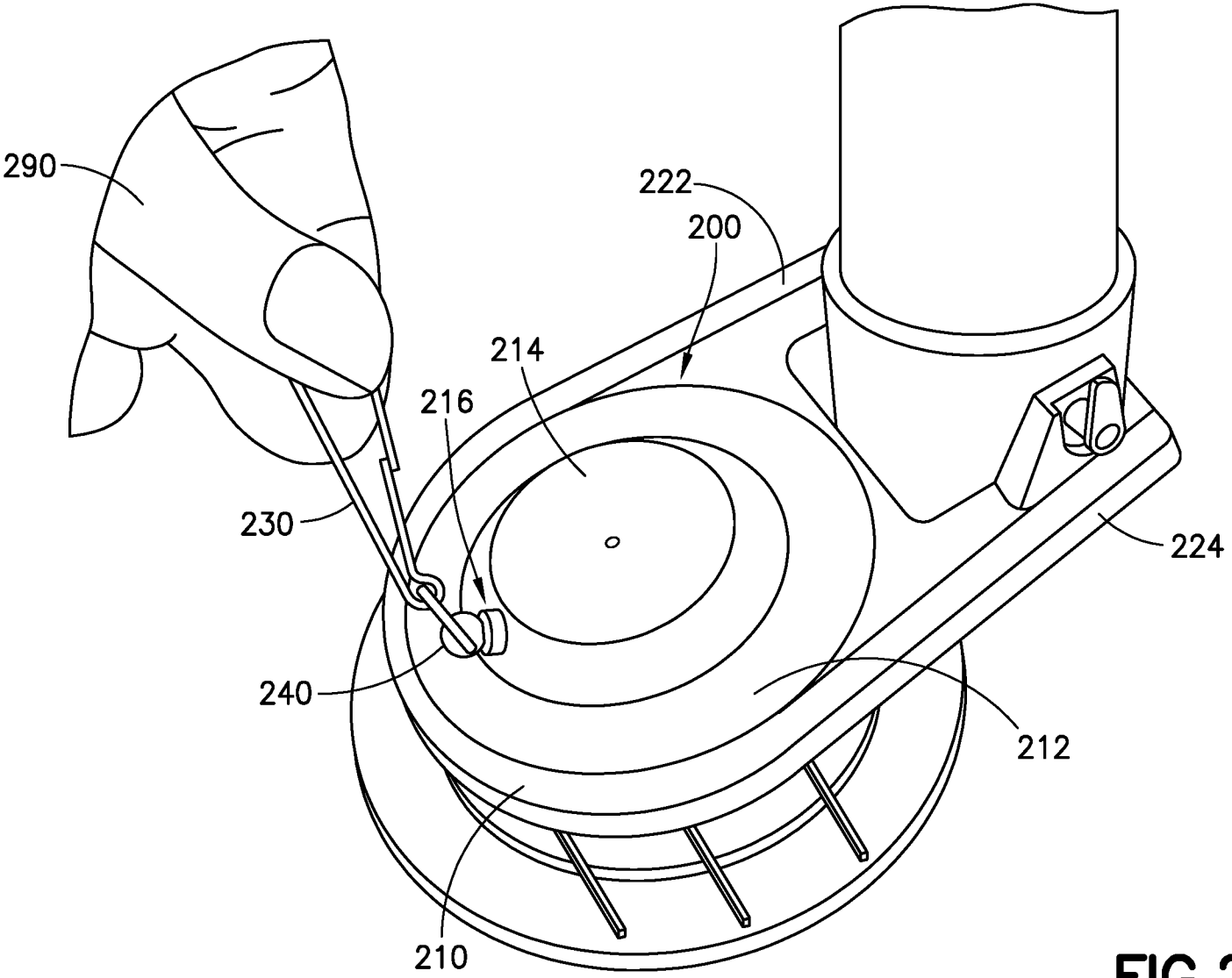
FIG. 2(*a*) is a photograph of an embodiment of a toilet flapper as described herein.
Figure 2B:
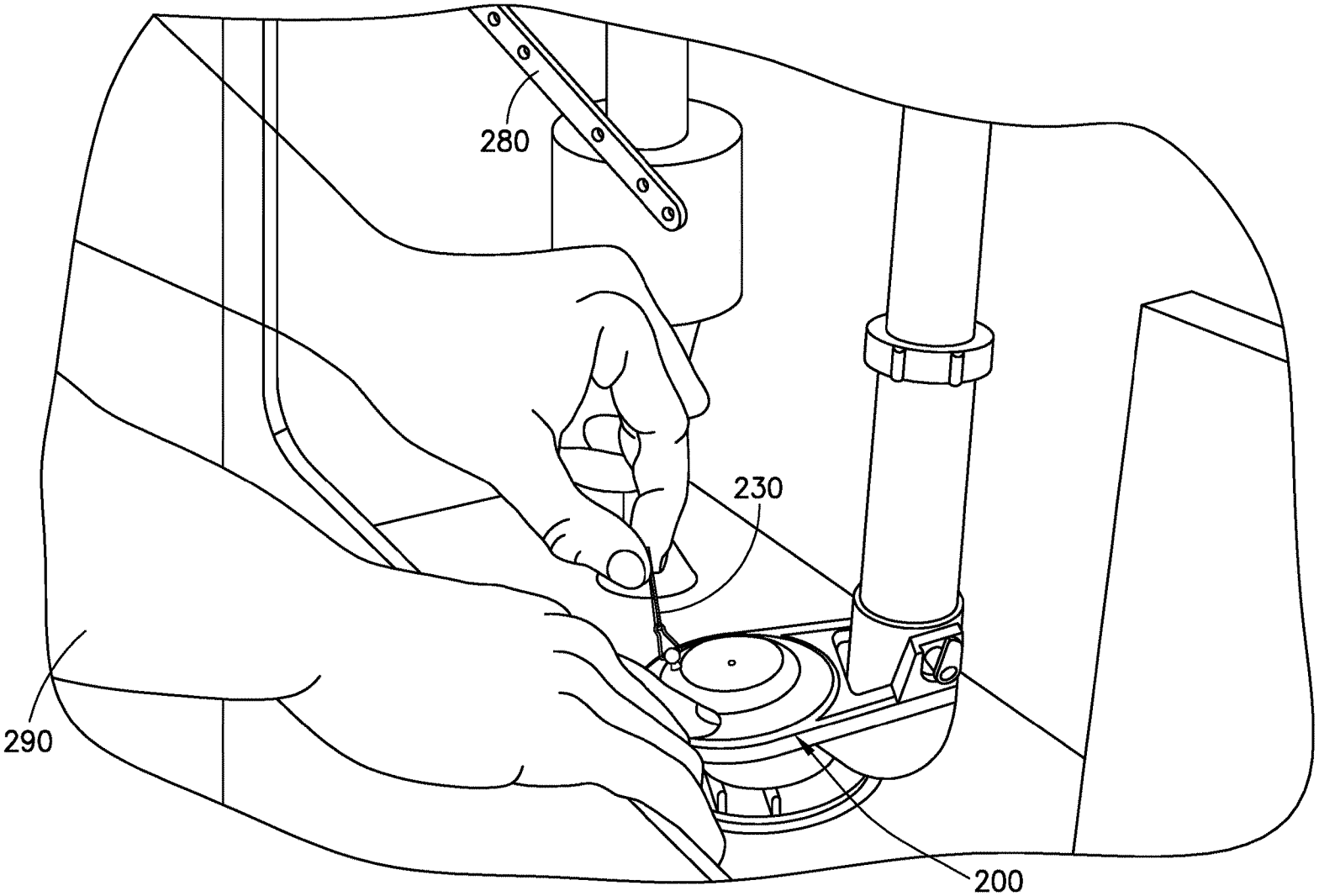
Figure 2C:
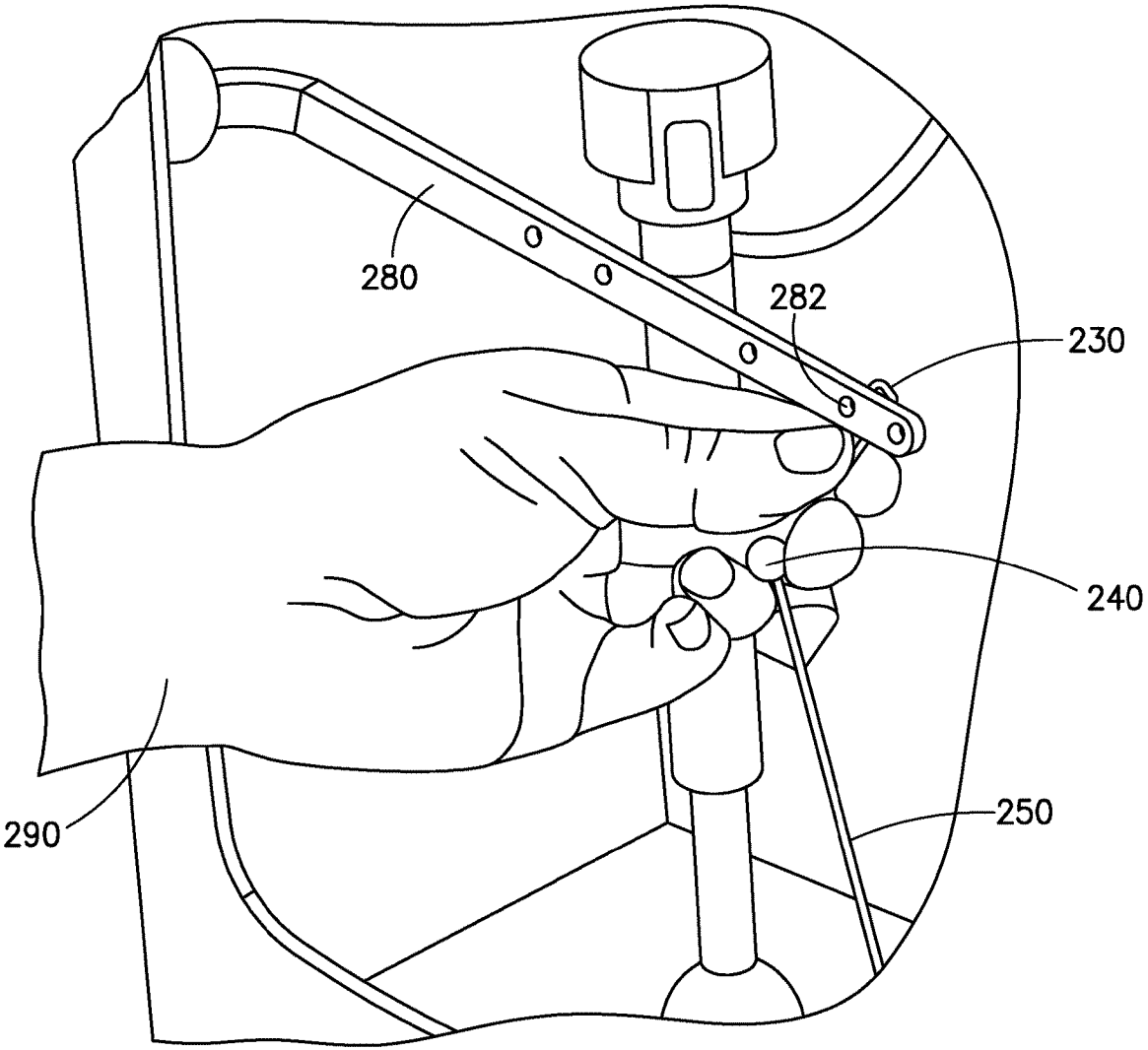

FIGS. 2(*a*)-(*c*) are photographs of a user installing an embodiment of a toilet flapper that is similar to toilet flapper 100 of FIG. 1 into a toilet. As shown, toilet flapper 200 includes body 210, arm 222, arm 224, hook 230, ball 240, and cord 250. Arms 222 and 224 may be used to moveably attach toilet flapper 200 to an overflow pipe near the drain hole of the water tank of a toilet. Body 210 has a top surface 212 and a bottom surface (not shown). The top surface 212 includes a raised portion 214. As shown in FIG. 2(*a*), cord 250 is rolled up inside of raised portion 214. Much like raised portion 114 of FIG. 1, raised portion 214 also houses a locking mechanism and a spring. The spring provides a force that pulls cord 250 into raised portion 214. Furthermore, when activated, the locking mechanism prevents the spring from pulling more of cord 250 back into raised portion 214.

As shown in FIGS. 2(*a*)-(*b*), in order to install toilet flapper 200, user 290 can grab hook 230 and pull a portion of cord 250 out of raised portion 214. As shown, cord 250 can be pulled out of raised portion 214 through hole 216. As shown in FIG. 2(*b*), user 290 may hold down toilet flapper 200 during this process in order to prevent it from lifting. As shown in FIG. 2(*c*), user 290 can pull just enough of cord 250 out of raised portion 214 in order to attach hook 230 to flush lever 280 through hole 282. After hook 230 is attached to flush lever 280, user 290 can activate the locking mechanism inside raised portion 214 by pushing down on raised portion 214. By doing so, user 290 can prevent the spring inside raised portion 214 from pulling any more of cord 250 back into raised portion 214.

Figure 3A:
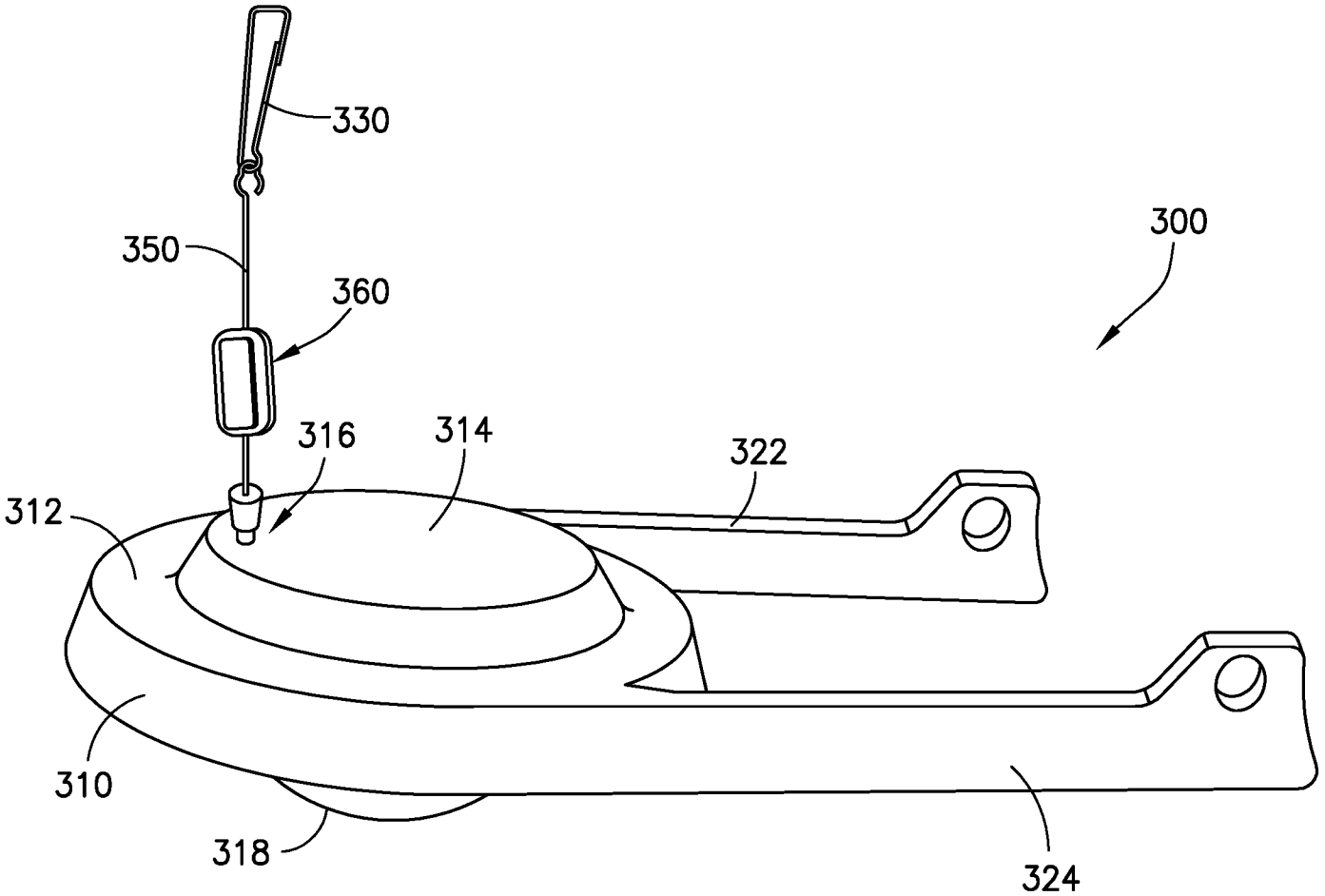
FIG. 3(*a*) illustrates an embodiment of a toilet flapper as described herein.
Figure 3B:
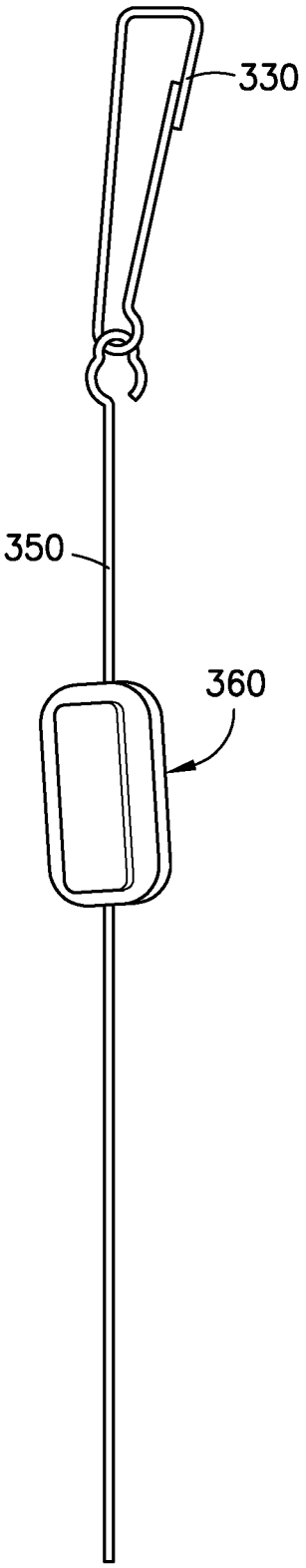
Figure 3C:
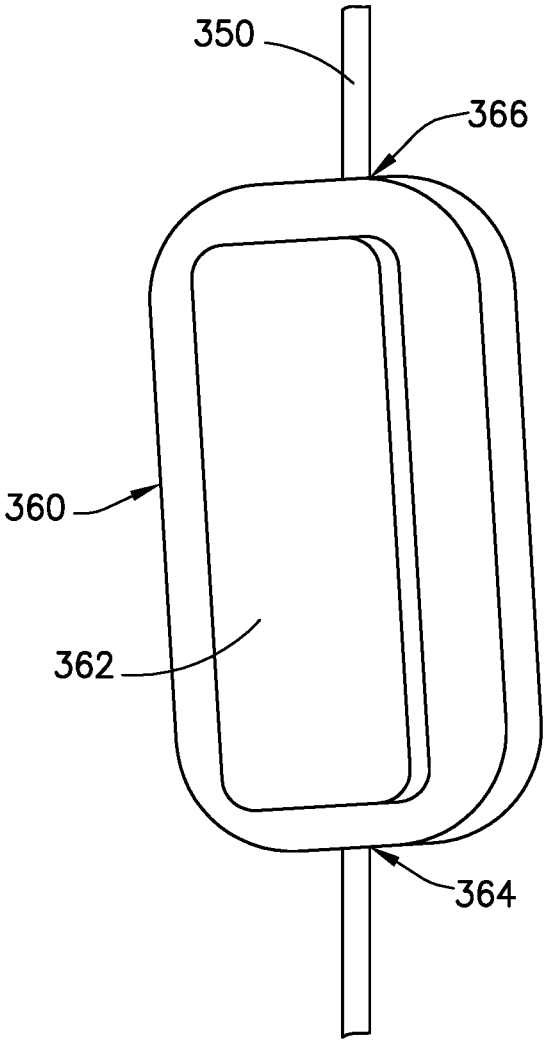

FIGS. 3(*a*)-(*c*) illustrate another embodiment of a toilet flapper. As shown, toilet flapper 300 includes body 310, arm 322, arm 324, hook 330, cord 350, and locking mechanism 360. Arms 322 and 324 may be used to moveably attach toilet flapper 300 to an overflow pipe near the drain hole of the water tank of a toilet. Body 310 has a top surface 312 and a bottom surface 318. The top surface 312 includes a raised portion 314. As shown, a portion of cord 350 is rolled up inside of raised portion 314. Raised portion 314 also houses a spring that provides a force that pulls cord 350 into raised portion 314.

In contrast to the embodiments of FIG. 1 and FIGS. 2(*a*)-(*c*), locking mechanism 360 is located outside of raised portion 314. More specifically, locking mechanism 360 is attached to a portion of cord 350 that is located outside of raised portion 314. As best shown in FIG. 3(*c*), in this embodiment, locking mechanism 360 includes button 362, inlet 364, and outlet 366. Cord 350 enters locking mechanism 360 through inlet 364 and exits out of outlet 366. Inside locking mechanism 360, there are one or more springs. When button 362 is not being pressed, these springs prevent locking mechanism 360 from sliding up or down cord 350. However, when button 362 is pressed by a user, locking mechanism 360 can slide freely up and down the portion of cord 350 that is outside of raised portion 314.

In order to install toilet flapper 300, a user can grab hook 330 and pull a portion of cord 350 out of raised portion 314. As shown, cord 350 can be pulled out of raised portion 314 through hole 316. After the user has connected hook 330 to, for example, a flush lever, the user can push down on button 362 and slide locking mechanism 360 down cord 350 so that it is touching hole 316. Once locking mechanism 360 is touching hole 316, the user can release button 362. By moving locking mechanism 360 down cord 350 so that it is touching hole 316, a user can prevent the spring inside raised portion 314 from pulling more of cord 315 back into raised portion 314. However, in some instances, a user may want the spring inside raised portion 314 to pull some of cord 350 back into raised portion 314. In such instances, a user may only slide locking mechanism 360 down a portion of cord 350 that is outside of raised portion 314. As a result, the portion of cord 350 that is between locking mechanism 360 and hole 316 will eventually be pulled back into raised portion 314 by the spring inside raised portion 314.

Figure 4:
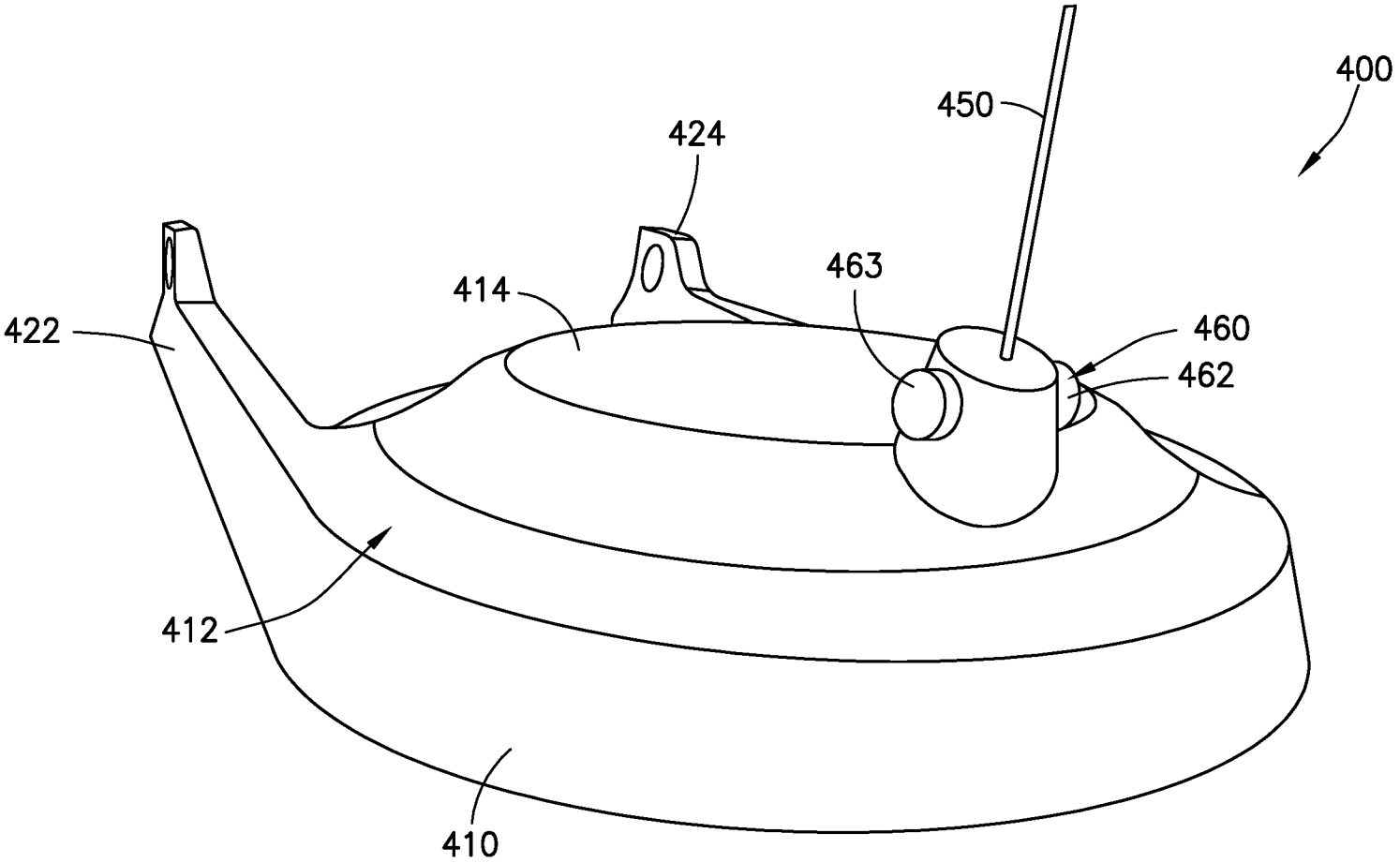
FIG. 4 illustrates an embodiment of a toilet flapper having a locking mechanism built into the toilet flapper as described herein.

FIG. 4 illustrates another embodiment of a toilet flapper. As shown, toilet flapper 400 includes body 410, arm 422, arm 424, cord 450, and locking mechanism 460. Arms 422 and 424 may be used to moveably attach toilet flapper 400 to an overflow pipe near the drain hole of the water tank of a toilet. Body 410 has a top surface 412 and a bottom surface (not shown). The top surface 412 includes a raised portion 414. As shown, a portion of cord 450 is rolled up inside of raised portion 414. Raised portion 414 also houses a spring that provides a force that pulls cord 450 into raised portion 314.

The embodiment of FIG. 4 is similar to the embodiment of FIGS. 3(*a*)-(*c*). However, in contrast to the embodiment of FIGS. 3(*a*)-(*c*), locking mechanism 460 is integrated with raised portion 414. In this embodiment, locking mechanism 460 includes buttons 462 and 463. When button 463 is depressed, the spring inside raised portion 414 is prevented from pulling more of cord 450 back into raised portion 414. However, when button 462 is depressed, the spring inside raised portion 414 is able to pull more of cord 450 back into raised portion 414. In this embodiment, when button 462 is depressed, button 463 is pushed outwardly to an undepressed state. Similarly, when button 463 is depressed, button 462 is pushed outwardly to an undepressed state.

From the foregoing and with reference to the various figure drawings, those skilled in the art will appreciate that certain modifications can also be made to the present disclosure without departing from the scope of the same. For example, in some embodiments, the cord may be stored in a separate device from the toilet flapper. In some embodiments, the separate device may be connected to a flush lever of a toilet. In such embodiments, the cord may be pulled out of the separate device and connected to a toilet flapper. Furthermore, in some embodiments, the separate device may also include a locking mechanism. For example, the separate device may be structured similarly to raised portion 114 of FIG. 1. More specifically, the separate device may contain a locking mechanism, one or more springs, a chamber for storing the cord, and a hole through which the cord may be pulled out of the device. As another example, the separate device may be structured similarly to raised portion 314 of FIGS. 3(*a*)-(*c*). More specifically, the separate device may contain one or more springs, a chamber for storing the cord, and a hole through which the cord may be pulled out of the device. Furthermore, a locking mechanism, much like locking mechanism 360 of FIGS. 3(*a*)-(*c*), may be positioned outside the separate device on a portion of the cord that is also outside the separate device. As yet another example, the separate device may be structured similarly to raised portion 414 and locking mechanism of FIG. 4. More specifically, the separate device may contain one or more springs, a chamber for storing the cord, and a hole through which the cord may be pulled out of the device. Furthermore, a locking mechanism can be integrated into the separate device near the hole.

While several embodiments of the disclosure have been shown in the drawings, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

The invention claimed is:

1. A toilet flapper comprising:

one or more arms;

a cord having a hook attached to a first end of the cord;

a body having a top surface and a bottom surface, wherein the top surface comprises a raised portion, wherein the raised portion houses one or more springs and at least a portion of the cord, wherein a second end of the cord is attached to the one or more springs inside the raised portion, wherein a portion of the cord may be pulled out of the raised portion by a user through an opening in the raised portion, and wherein the one or more springs impart a retraction tension on the cord that pulls the cord back into the raised portion; and a locking mechanism for imparting a locking tension that is equal to or greater than the retraction tension imparted by the one or more springs in the raised portion of the body thereby preventing the one or more springs from pulling a portion of the cord that has been pulled out of the raised portion by a user back into the raised portion.

2. The toilet flapper of claim 1, wherein a ball connects the first end of the cord to the hook.

3. The toilet flapper of claim 1, wherein the one or more springs inside the raised portion include at least one spiral torsion spring.

4. The toilet flapper of claim 1, wherein the one or more arms are configured to attach the toilet flapper to an overflow pipe in a water tank of a toilet.

5. The toilet flapper of claim 1, wherein a length of the cord is sufficient to connect the hook to a flush lever of a toilet after the toilet flapper has been positioned above a drain hole of a water tank of the toilet such that the toilet flapper seals the drain hole.

6. The toilet flapper of claim 1, wherein the locking mechanism is housed inside the raised portion of the body.

7. The toilet flapper of claim 6, wherein the locking mechanism comprises a button, and wherein the locking mechanism is oriented and positioned within the raised portion such that a user can press the button by pressing down on the raised portion.

8. The toilet flapper of claim 7, wherein a user can activate or deactivate the locking mechanism by pressing the button.

9. The toilet flapper of claim 1, wherein the locking mechanism is outside of and separate from the raised portion of the body, and wherein the locking mechanism is attached to a portion of the cord that is outside of the raised portion.

10. The toilet flapper of claim 9, wherein the locking mechanism comprises a button, an inlet, and an outlet, wherein the cord enters the locking mechanism through the inlet and exits the locking mechanism through the outlet, wherein the locking mechanism configured to slide up or down the cord when the button is depressed, and wherein the locking mechanism is configured to resist sliding up or down the cord the button is undepressed.

11. The toilet flapper of claim 1, wherein the locking mechanism is integrated with the opening in the raised portion of the body.

12. The toilet flapper of claim 11, wherein the locking mechanism comprises a first button and a second button, wherein the locking mechanism is configured such that the one or more springs in the raised portion of the body are prevented by the locking mechanism from pulling a portion of the cord that has been pulled out of the raised portion by a user back into the raised portion when the first button is depressed, and wherein the locking mechanism is configured such that the one or more springs in the raised portion of the body are allowed by the locking mechanism to pull a portion of the cord that has been pulled out of the raised portion by a user back into the raised portion when the second button is depressed.

13. The toilet flapper of claim 12, wherein the first and second buttons are configured such that (a) when the first button is depressed, the second button is pushed outwardly to an undepressed state and (b) when the second button is depressed, the first button is pushed outwardly to an undepressed state.

14. The toilet flapper of claim 1, wherein the locking mechanism is integrated with the raised portion of the body.

15. The toilet flapper of claim 14, wherein the locking mechanism is configured such that the one or more springs in the raised portion of the body are allowed by the locking mechanism to pull a portion of the cord that has been pulled out of the raised portion by a user back into the raised portion when a portion of the locking mechanism is depressed.

16. The toilet flapper of claim 14, wherein the locking mechanism is configured such that the one or more springs in the raised portion of the body are prevented by the locking mechanism from pulling a portion of the cord that has been pulled out of the raised portion by a user back into the raised portion when a portion of the locking mechanism is undepressed.

17. A toilet flapper comprising:

one or more arms;

a cord having a hook attached to a first end of the cord;

a body having a top surface and a bottom surface, wherein the top surface comprises a raised portion, wherein the raised portion houses one or more springs and at least a portion of the cord, wherein a second end of the cord is attached to the one or more springs inside the raised portion, wherein a portion of the cord may be pulled out of the raised portion by a user through an opening in the raised portion, and wherein the one or more springs impart a retraction tension on the cord that pulls the cord back into the raised portion unless another tension or equal or greater force is exerted on the cord; and a locking mechanism comprising a button, an inlet, and an outlet, wherein the cord enters the locking mechanism through the inlet and exits the locking mechanism through the outlet, wherein the locking mechanism configured to slide up or down the cord when the button is depressed, and wherein the locking mechanism is configured to resist sliding up or down the cord the button is undepressed.

18. The toilet flapper of claim 17, wherein the one or more springs inside the raised portion include at least one spiral torsion spring.

19. The toilet flapper of claim 17, wherein at least a portion of a chamber inside the raised portion extends vertically below the entirety of the top surface of the body, and wherein the one or more springs and the at least a portion of the cord are housed in the chamber.

20. The toilet flapper of claim 17, wherein a length of the cord is sufficient to connect the hook to a flush lever of a toilet after the toilet flapper has been positioned above a drain hole of a water tank of the toilet such that the toilet flapper seals the drain hole.

21. A method for using the toilet flapper of claim 17, the method comprising:

positioning the toilet flapper of claim 14 above a drain hole of a water tank of a toilet such that the toilet flapper seals the drain hole;

attaching the hook of the toilet flapper to a flush lever of the toilet, in part, by pulling a portion of the cord out of the raised portion of the toilet flapper;

pressing down on the button of the locking mechanism and simultaneously sliding the locking mechanism down the cord toward the body of the toilet flapper; and releasing the button of the locking mechanism.

22. The method of claim 21, wherein the locking mechanism is slid down the cord until it touches an opening in the raised portion of the body of the toilet flapper.

23. The method of claim 21 further comprising:

attaching the toilet flapper to an overflow pipe in the water tank of the toilet.

* * * * *